United States Patent [19]

Fischer

[11] 4,097,039

[45] Jun. 27, 1978

[54] STRIP LAYING APPARATUS

[75] Inventor: Thomas A. Fischer, Fargo, N. Dak.

[73] Assignee: Applied Power Inc., Menomonee Falls, Wis.

[21] Appl. No.: 708,065

[22] Filed: Jul. 23, 1976

[51] Int. Cl.[2] ..... B65H 45/20

[52] U.S. Cl. ..... 270/79; 19/163

[58] Field of Search ..... 270/30–31, 270/61 F, 73, 79; 19/160, 163; 53/116, 117; 28/21, 22

[56] References Cited

U.S. PATENT DOCUMENTS

| | | | |
|---|---|---|---|
| 2,737,390 | 3/1956 | Morgan | 270/79 |
| 3,083,437 | 4/1963 | Davis | 19/160 |
| 3,227,390 | 1/1966 | Wendelken | 270/31 |
| 3,917,250 | 11/1975 | Branick | 270/30 |

*Primary Examiner*—Edgar S. Burr
*Assistant Examiner*—A. Heinz
*Attorney, Agent, or Firm*—Fred Wiviott

[57] ABSTRACT

An apparatus for laying an elongate strip in substantially uniform layers and side-by-side rows includes a conveyer assembly for receiving a generally horizontally traveling material and for delivering the same to the upper end of a hollow, generally vertically extending, universally pivotable feed chute. The lower end of the feed chute is coupled to a first slider which is mounted for reciprocal sliding movement in a first horizontal direction on a second slider mounted in turn on the main frame for reciprocal sliding movement in a second horizontal direction normal to the first. A drive assembly reciprocates the first slider at a first rate of speed and simultaneously reciprocates the second slider in the second direction and at a slower speed rate for delivering the material in the desired pattern from the lower end of the feed chute. A speed matching assembly adjusts the speed of the strip laying apparatus to that of the strip received from other process machinery.

37 Claims, 10 Drawing Figures

STRIP LAYING APPARATUS

BACKGROUND OF THE INVENTION

This invention relates to apparatus for laying strip material in relatively uniform layers and in side-by-side rows.

One of the problems encountered in the manufacture of strip material, such as rubber strips, which may, for example, be employed in the manufacture of tires, has been to package such material in suitable containers for shipment. It will be appreciated that at the point of ultimate use, such material is commonly fed into some continuous process apparatus. Accordingly, the disposition of such material in a container must be such that there will be no tangling or twisting which would interfere with the uniform material withdrawal and feeding into the process apparatus.

One prior art apparatus for laying strip material is disclosed in U.S. Pat. No. 3,917,250 which is assigned to the assignee of the present invention. While such prior art apparatus was able to effectively lay strip material in the desired pattern, it required that the material be threaded through the apparatus prior to the commencement of a strip laying operation. Further, the carriage and drive apparatus of the patent was relatively complex and could not be readily adjusted for layer length and width. Also, the apparatus of the patent was subject to jamming when connected directly to strip production apparatus because of drift away from nominal speeds.

SUMMARY OF THE INVENTION

An object of the invention is to provide a new and improved strip laying apparatus.

A further object of the invention is to provide a strip laying apparatus which is self-threading.

Another object of the invention is to provide a strip laying apparatus having simplified carriage and drive mechanisms.

It is a further object of the invention to provide a strip laying apparatus which can readily be adjusted with respect to layer length and width.

It is another object of the invention to provide a strip laying apparatus which is capable of matching the speed of strip delivery.

These and other objects and advantages of the present invention will become more apparent from the detailed description thereof taken with the accompanying drawings.

In general terms, the invention comprises apparatus for laying a strip material including first translating means movably mounted on support means for reciprocating movement in a first direction and in an opposite direction, and second translating means mounted on the first translating means for reciprocating movement in a second direction generally normal to the first direction. Elongate material distributing means is mounted on the support means for generally universal pivotal movement for receiving material at its upper end and discharging the same from its lower end and being coupled to the second translating means for movement therewith. Drive means coupled to each of the translating means for moving the first translating means in the first and the opposite direction and for reciprocating the second translating means in the second direction on the first translating means. Conveyer means is provided for receiving an elongated strip of material and conducting the material upwardly to the upper end of said distributing means and for delivering the same downwardly to the upper end of the distributing means.

According to one aspect of the invention, the conveying means includes elongate means movable generally upwardly toward the upper end of the distributing means, the conveying means including pressure means for biasing a strip of material against said elongate means whereby the latter moves said material upwardly to said distributing means.

In accordance with another aspect of the invention, the first translating means comprises slider means, first slider supporting means mounted on the support means for supporting the slider means for sliding movement in the first and opposite directions on the support means, the first translating means also including second slider supporting means extending in the second direction, the second translating means including tubular means slidably mounted on the second slider supporting means for reciprocating movement thereon.

According to yet another aspect of the invention, the drive means includes crank means pivotally mounted for movement of its free end in a plane generally parallel to one of the directions and linkage means connecting the crank means to one of the translating means for moving the same in the one of the directions and means for adjusting the point of engagement between the crank means and the linkage means relative to the pivotal axis of the crank means so that adjustment thereof will change the degree of reciprocation of the translating means.

In accordance with another aspect of the invention, the drive means includes speed adjusting means comprising means for sensing increases or decreases in the strip material delivery speed and for increasing or decreasing the drive means speed in accordance therewith.

DETAILED DESCRIPTION OF THE INVENTION

Figure 1:
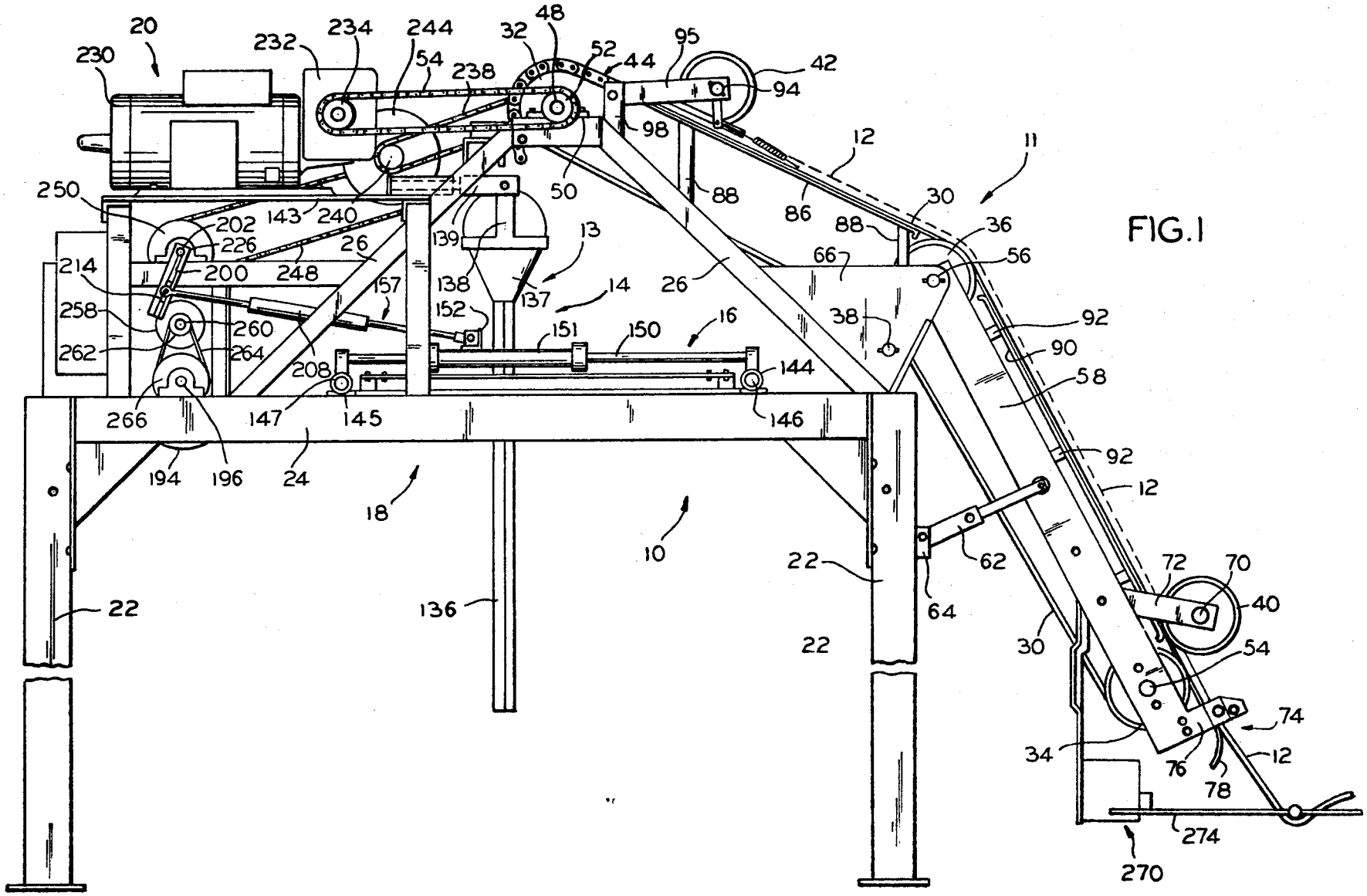
FIG. 1 is a side elevational view of the apparatus according to the present invention.

The strip laying apparatus 10 is shown generally in FIG. 1 to include a conveyor assembly 11 for receiving a strip material 12 and for delivering the same to the upper end of a generally vertically extending hollow feed chute 13 which is supported for universal pivoting movement. The feed chute 13 is coupled intermediate its ends to a secondary slider 14 and is mounted for reciprocating movement in a first generally horizontal direction on a primary slider 16 which in turn is slidably mounted on a main frame 18 for generally horizontal reciprocation in a second direction generally normal to the first direction. A drive assembly 20 is coupled to the secondary slider for moving the same in a reciprocating path whereby the lower end of the chute 13 is pivoted in the first direction. In addition, the drive assembly 20 is also coupled to the primary slider for reciprocating the same in the second direction at a slower speed than the secondary slider so that the lower end of the chute simultaneously moves in the first and second directions.

The main frame 18 may be formed of any suitably shaped structural members which are joined in any convenient manner and may include four vertical corner posts 22 which are joined by side members 24 and end members 25. In addition, there is a pair of generally parallel upper frame portions 26 which have a generally inverted V-shaped configuration and whose apexes are joined by a cross member 27. The front lower ends of the frame portions 26 are affixed to the front cross member 25 at spaced apart points inwardly of post 22 while the rear lower ends of portions 26 are affixed to a transverse cross member 28 extending horizontally between and affixed to the side members 24.

Conveyor 11 includes an endless belt 30 which passes around a drive roller 32 mounted above chute 13, a first traction roller 34 mounted at the inlet of conveyor 11, a second traction roller 36 mounted between rollers 32 and 34 and an idler tube 38 mounted adjacent to roller 36. A first nip roller 40 is mounted adjacent traction roller 34 and a second nip roller 42 is mounted adjacent drive roller 32. In addition, a guide roller assembly 44 is disposed above belt 30 and adjacent the drive roller 32.

In general terms, the conveyor assembly receives the strip material 12 adjacent the traction roller 34 and between the belt 30 and the nip roller 32 and with the traction roller 32 operating in a counterclockwise direction as viewed in FIG. 1, the strip 12 will be carried upwardly into the nip roller 42 which will direct the same beneath the guide roller assembly 44 and downwardly into the open upper end of the chute 14 as will be discussed more fully below.

Drive roller 32 is generally cylindrical and is mounted on a shaft 48 which in turn is journaled for rotation about a generally horizontal axis by suitable bearings 50 which are mounted in spaced relation at the upper end of frame portions 26. A sprocket 52 is affixed to one end of shaft 48 and is coupled by a roller chain 54 to the drive assembly 20 whereby the drive roller 32 may be driven at the desired operating speed as will be described more fully below.

Figure 3:
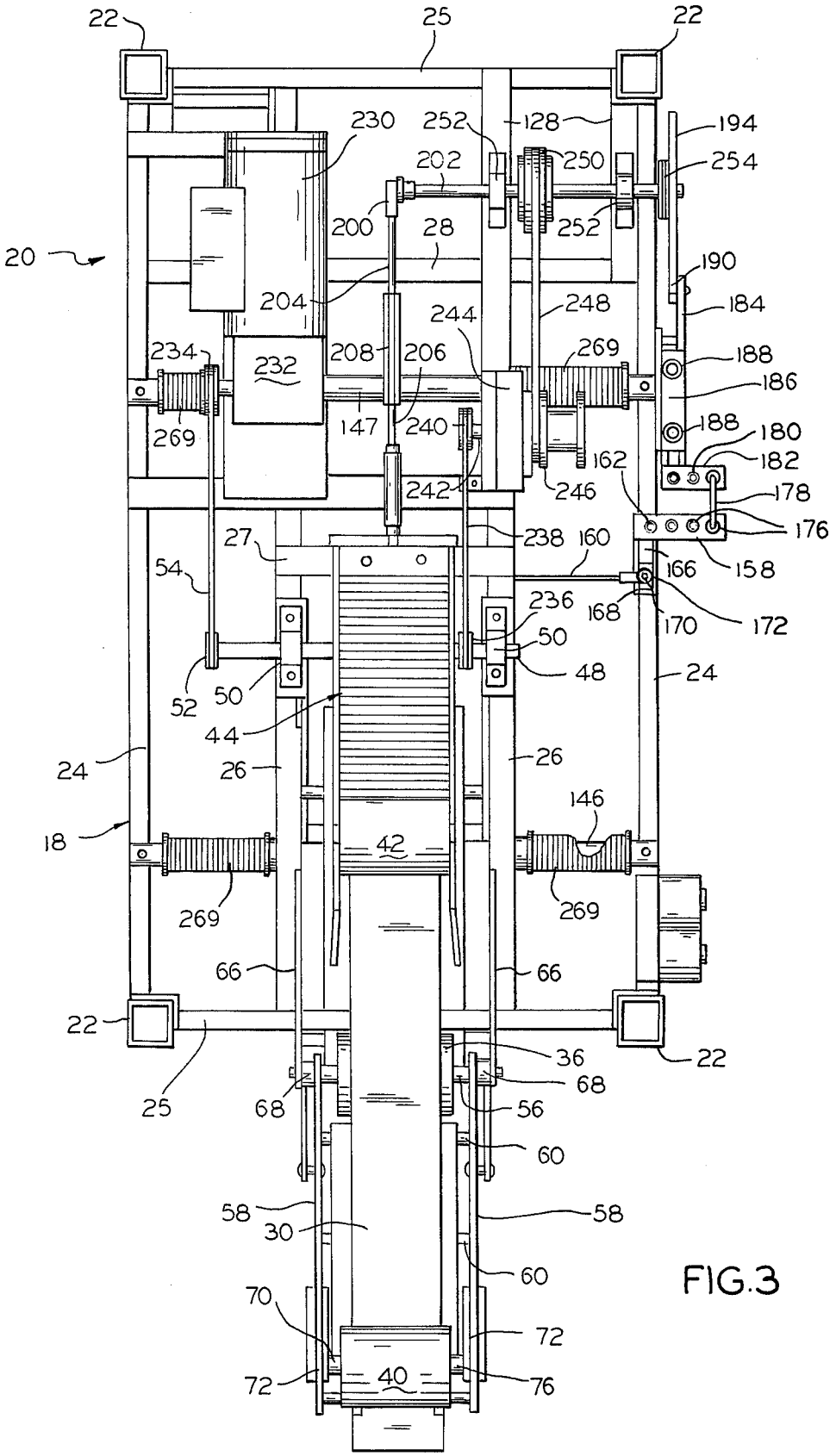
FIG. 3 is a top plan view of the apparatus illustrated in FIG. 2.

The traction rollers 34 and 36 are respectively mounted on shafts 54 and 56 journaled for rotation adjacent the opposite ends of a pair of elongate, generally parallel members 58 which form a portion of a conveyor frame. Members 58 may be held in spaced relation in any suitable manner such as by means of cross members 60. Also, members 58 may be supported from frame 18 by means of a pair of inclined, extensible brace assemblies 62 which are pivotally connected at their upper ends to members 58 and at their lower ends to a cross member 64 which extends between the front upright frame members 22. In addition, the upper ends of members 58 are pivotally mounted to a pair of triangular bracket members 66 which are affixed in parallel spaced apart relation to the upper frame portions 26. Specifically, the shaft 56 of traction roller 36 extends through bracket members 66 and is journaled for rotation therein by suitable bearings 68 (FIG. 3). In addition, members 58 are pivotally mounted on shaft 56. Further, support 62 is suitably lengthwise adjustable so that the angle of inclination of the members 58 and accordingly, the end feed portion of conveyor 11 is adjustable.

Figure 5:
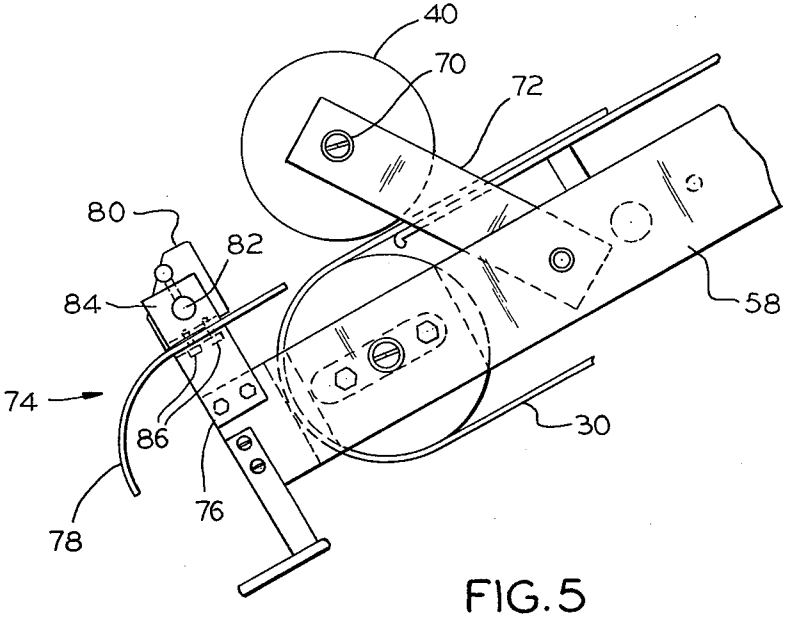
FIGS. 4 and 5 illustrate in greater detail the infeed conveyor portions of the apparatus shown in FIG. 1.
Figure 4:
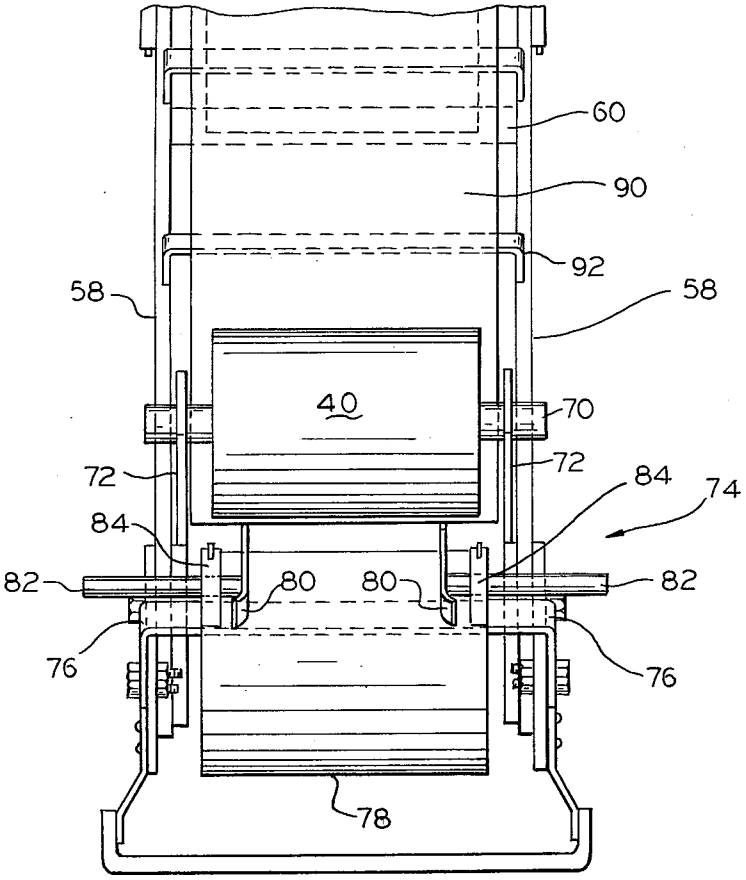

Reference is now made to FIGS. 4 and 5 which shows the nip roller 40 to be affixed to a shaft 70 which is journaled for rotation between the ends of a pair of arms 72, the opposite ends of which are pivotally mounted to the conveyor frame members 58. As a result, the weight of nip roller 40 biases the same downwardly against the belt 30 while the pivotal mounting of arms 72 permit the nip roller 40 to be displaced away from belt 30 as the lead end of strip material 12 moves beneath nip roller 40. In this manner, nip roller 40 holds strip material 12 against the belt 30 as the latter moves toward the upper nip roller 42 whereby the strip material 12 will be carried therealong.

A guide assembly 74 is shown in FIGS. 4 and 5 to be mounted at the lower end of the conveyor 11 by means of a U-shaped bracket 76 whose opposite ends are affixed to the members 58. Assembly 74 includes a first guide members 78 affixed to the center portion of bracket 76 and generally tangent to the belt 30 at a point just below nip roller 40 while the opposite end of member 78 curves downwardly as seen in FIG. 5. In addition, a pair of guide members 80 are mounted at the inner end of one of a pair of rods 82 adjustably supported by clamp members 84 secured to brackets 76 by means of bolts 86. Clamping members 84 also serve to secure the member 78 in position. As seen in FIG. 4, the lower ends of the side members 80 flare outwardly whereby the guide assembly 74 will center the end of a strip 12 moving toward the lower end of conveyor 11 and direct the same into the gap between the nip roll 40 and the belt 30. The rods 82 are adjustably secured by clamping members in any suitable manner so that the members 80 may be moved toward and away from each other to accommodate strip materials of different widths.

In order to minimize sag of the belt 30 in the gaps between the rollers 32 and 36 and the rollers 36 and 34, a first planer support 86 is mounted below belt 30 by means of members 88 extending upwardly from frame 18 and a second planer support 90 is mounted below belt 30 by means of generally U-shaped brackets 92 which extend between members 58.

Figure 6:
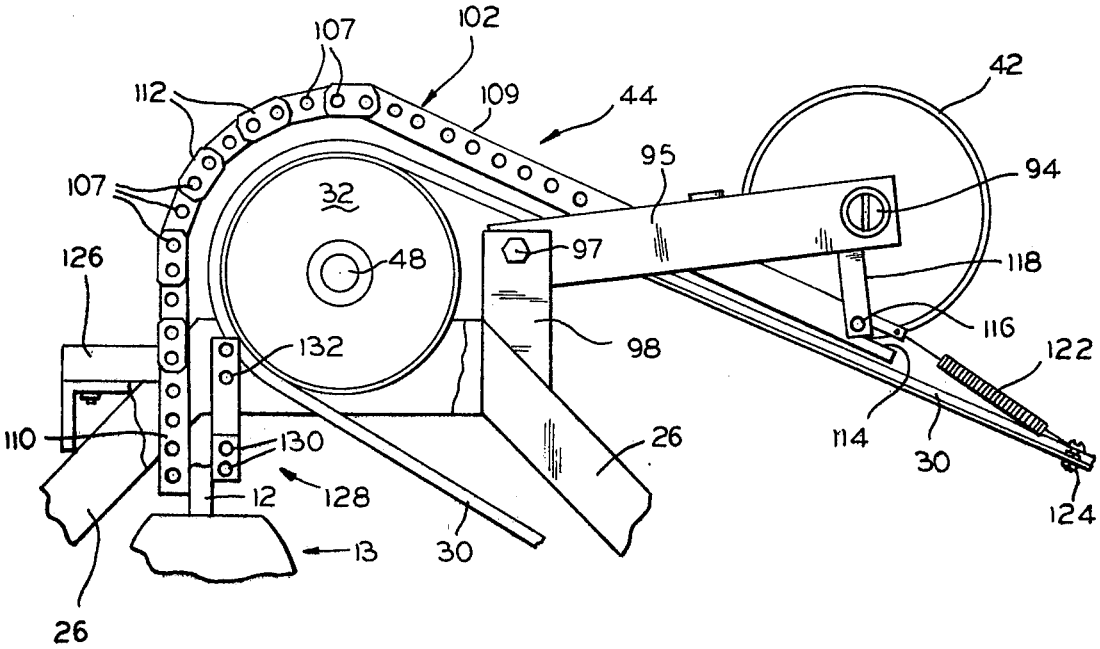
Figure 8:
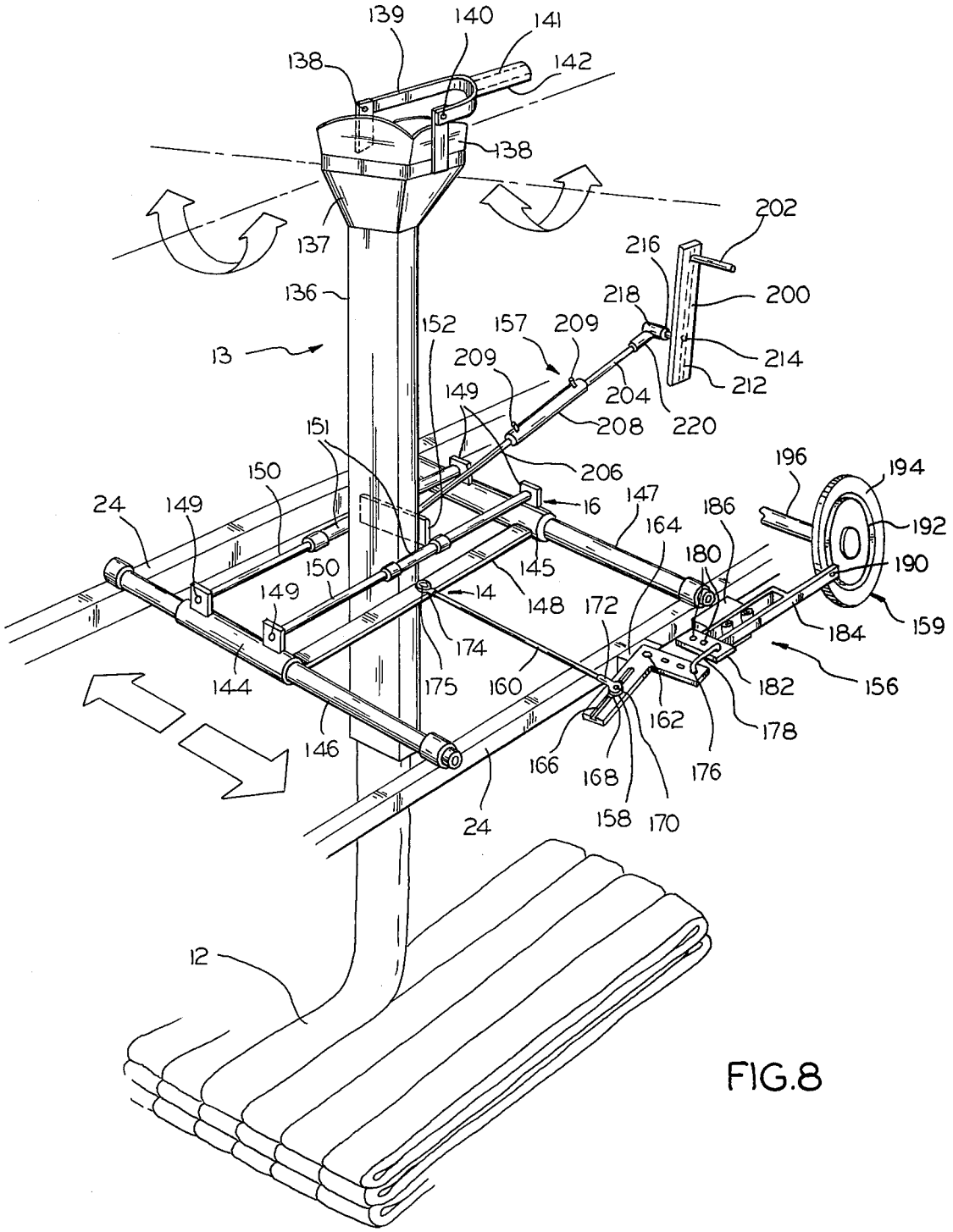
FIG. 8 is a perspective view schematically illustrating the carriage and its associated drives of the apparatus illustrated in FIG. 1.

Reference is now made to FIG. 6 which shows the nip roller 42 to be affixed to a shaft 94 which is journaled for rotation between the ends of a pair of arms 95. The opposite ends of arms 95 are pivotally mounted at 97 to brackets 98 extending upwardly from the frame portions 26.

Figure 7:
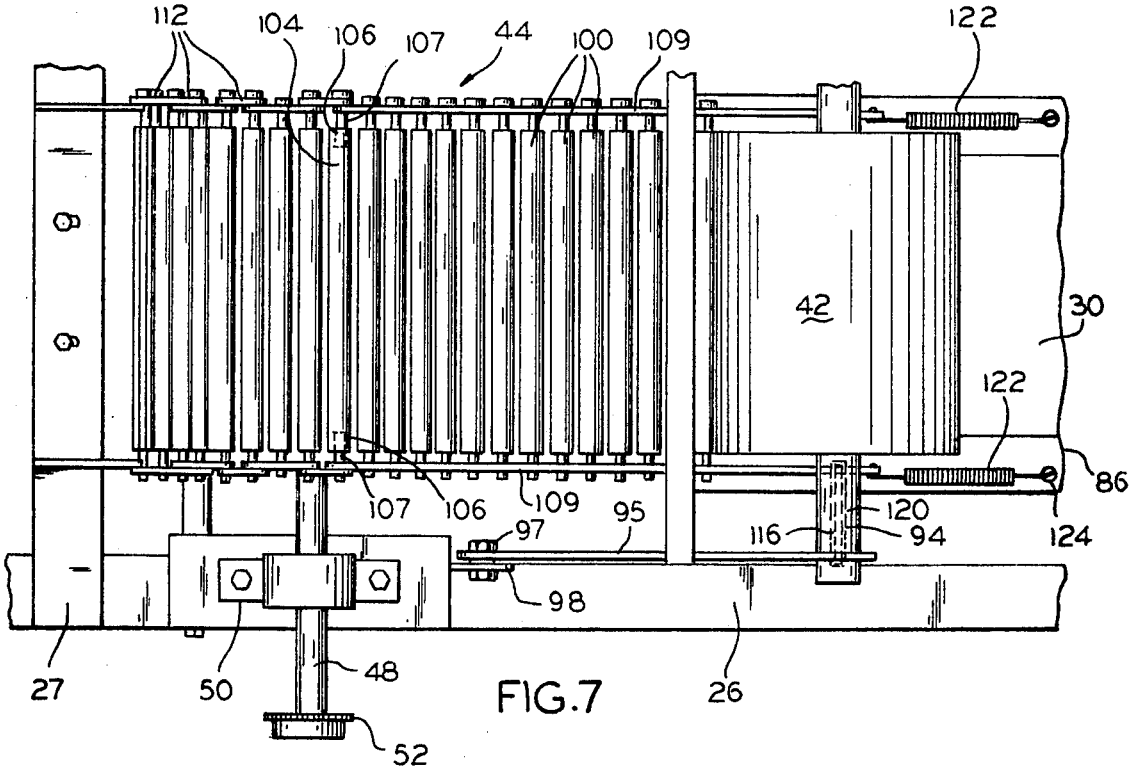
FIGS. 6 and 7 illustrate in greater detail the discharge conveyor portions of the apparatus of FIG. 1.

The guide roller assembly 44 is shown in FIGS. 6 and 7 to be disposed above the tension roll 32 and adjacent the nip roll 42 and includes a plurality of generally parallel guide rollers 100 which extend transversely above belt 30 and between a pair of articulated roller frames 102. Each roller 100 includes a roller tube 104 whose opposite ends are received on a cylindrical bearing 106. A pin 107 extends from each bearing 106 and through an opening in roller frames 102 and each is suitably secured therein. Each roller frame 102 includes an elongate inlet member 109, a relatively shorter outlet member 110 and a plurality of short segments 112 disposed therebetween. The pins 107 which extends through aligned openings in each of the adjacent portions of the members 109, 110 and segments 112 act to couple these members into an articulated chain. The inlet member 109 is disposed above the inclined belt 30 and extends from the nip roll 40 up to the belt's point of tangency with nip roll 32. The outlet section 110 of roller frame 102 is oriented generally vertically.

The upstream end of member 109 extends past the nip roll 94 and includes a slot 114 which extends over a pin 116 whose opposite end is affixed in the lower end of a bracket 118 extending downwardly from arm 95. A spacer tube 120 is disposed around pin 94 and maintains the member 109 in alignment with the belt 30. A return spring 122 extends between the end of member 109 and a bolt 124 which is affixed to the belt support 86 at a point adjacent belt 30. At the opposite end of the guide roller assembly 44, the frame portion 112 is affixed in a vertical position by means of a bracket assembly 126 affixed to the frame portion 26. In addition, an anti-return roller assembly 128 is disposed adjacent the exit end of guide roller assembly 44 and includes a pair of rollers 130 which are generally parallel to the rollers 100 and are supported between brackets 132 which extend downwardly from frame section 128 and in general parallelism and spaced from frame member 112.

The segments 112 and the rollers 110 which extend therebetween form a transition section between the sections defined by members 109 and 110. It will be appreciated, therefore, that as the strip material 12 moves upwardly along belt 30, it will be redirected by the guide rollers 109 downwardly into the open upper end of feed chute 13. The anti-return roller assembly 128 insures that the strip 12 will be directed downwardly into the feed chute 13 and not follow the belt 30 in its return path toward the lower end of the conveyor assembly 11.

Figure 9:
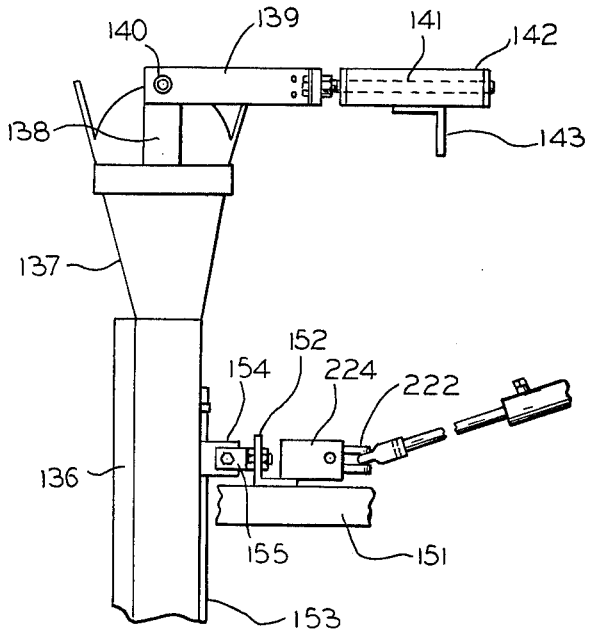
FIG. 9 illustrates in greater detail a portion of the feed mechanism of the apparatus illustrated in FIG. 1.

As seen in FIGS. 1 and 9, the feed chute 13 includes a hollow, open-ended, tubular member 136 which is shown in the illustrated embodiment as being generally rectangular in transverse cross section although any convenient cross-sectional configuration may be employed. An inlet 137 is disposed at the upper end of tubular portion 136 and flares outwardly and upwardly so that the downwardly directed strip material 12 will be guided into the tubular portion 136. A pair of bracket members 138 extend upwardly from the lateral sides of inlet 137 and are pivotally connected to the ends of a yoke 139 by pins 140. A shaft 141 pivotally supports yoke 139 for rotation about an axis normal to the pivot axis of brackets 138 and is in turn journaled in a bearing sleeve 142 supported on an auxiliary frame portion 143. It can be seen, therefore, that the chute 13 can pivot about a first horizontal axis defined by the pins 140 which secure it to the yoke 139 and a second axis normal to the first axis and defined by the shaft 141.

Primary slider 16 includes a generally tubular front slider 144 and a generally tubular rear slider 145 which are respectively telescoped onto rods 146 and 147 which are mounted in parallel spaced apart relation on the frame side of members 24. The sliders 144 and 145 are joined by a frame member 148 which is suitably affixed to each and which extends therebetween in general parallelism with the frame side members 24. In addition, a pair of brackets 149 extends upwardly from each of the sliders 144 and 145 for supporting a pair of slide tubes 150 which are affixed at their opposite ends to brackets 149 and are disposed in parallelism with the slide frame member 148. Surrounding each of the slide tubes 150 is a relatively short slider 151 which are each attached to each other by a cross member 152. The feed tube 136 has a slide bar 153 affixed to one side for being engaged by a slide bar link 154 which in turn is pivotally connected by means of a clevis 155 to the cross member 152. The primary slider assembly 14 and the secondary slider assembly 16 are respectfully connected to the apparatus main drive 20 by means of a first linkage assembly 156 and a second linkage assembly 157.

Linkage 156 includes a crank 158 which is mounted on frame side member 24 for pivotal movement about a generally vertical axis under the influence of an eccentric cam assembly 159. A link 160 couples the cam assembly 159 to the primary slide assembly 14. More specifically, crank 158 is generally L-shaped and is pivotally mounted by means of a pin 162 extending into a bearing 164 affixed to the side of member 24. A slot 166 is formed in one of the legs of crank 158 for receiving an adjustable slider 168 whose position may be fixed as desired in any position within the slot 166. A pin 170 extends upwardly from slider 168 and is received within an eyelet 172 mounted on the end of rod 160. A similar eyelet 174 is mounted on the opposite end of rod 160 and engages a pin 175 affixed to and extending upwardly from the cross member 148 of the primary slide assembly 14. The other leg of crank 158 is provided with a plurality of transverse apertures 176 for receiving one end of an inverted U-shaped link 178. The other end of link 178 is received in one of a plurality of apertures 180 formed in a bell crank drive member 182.

The member 182 is mounted at the end of a bifurcated link 184 which is mounted for reciprocal movement within a bearing 186. Specifically, the legs of link 184 straddle a pair of bushings 188 which extend upwardly from bearing 156 to insure longitudinal movement of link 184. The bearing 186 may be provided with suitable slide bearings to facilitate reciprocal movement. A cam follower 190 is affixed to the end of rod 184 and is received within a circular cam surface 192 formed in the face of a disc-shaped cam 194 which is eccentrically mounted for rotation about a horizontal axis on a shaft 196.

It will be appreciated that as shaft 196 rotates cam 194 eccentrically, the engagement between the cam follower 190 and the generally circular cam surface 192 will move the link 184 through a horizontal reciprocatory path. This will cause the crank 158 to pivot about pin 162 thereby moving link 160 longitudinally. This in turn will move the primary slide assembly 14 on the slide tubes 146 and 147.

The linkage assembly 157 includes a crank 200 which is mounted on a shaft 202 for rotation about an axis parallel to that of the slide tubes 146 and 147. A first push rod 204 is coupled to crank 200 and a second push rod 206 is coupled to the cross member 152 of the secondary slide assembly 16. A coupler tube 208 is telescopingly received over the ends of rods 204 and 206 and is connected thereto by means of set screws 209. In this manner, the length of a coupling connection between crank 200 and secondary slider 16 may be adjusted. This allows the operator to place the chute 13 in a vertical position with the crank 200 in line with the coupler tube 208, then place the container directly below and centered on the chute 13 to allow equal distribution of the rubber to each end of the container. Crank 200 has a longitudinal slot 212 formed in one side for receiving an adjustable slider member 214 which has a pin 216 extending therefrom. Affixed to pin 216 is a pivot bar 218 which is pivotally connected by means of a U-joint 220 to the end of push rod 204. A similar U-joint 222 connects the end of push rod 206 to a block 224 affixed to cross member 152 of secondary slider 16. It will be appreciated that rotation of crank 200 about the axis of shaft 202 will cause the secondary slider 16 to move longitudinally along slide tubes 150 and to move the discharge chute 13 in a like path. Shaft 202 is shown in FIG. 1 to be mounted for rotation in bearing 226 which is affixed on the auxiliary frame portion 143.

Figure 2:
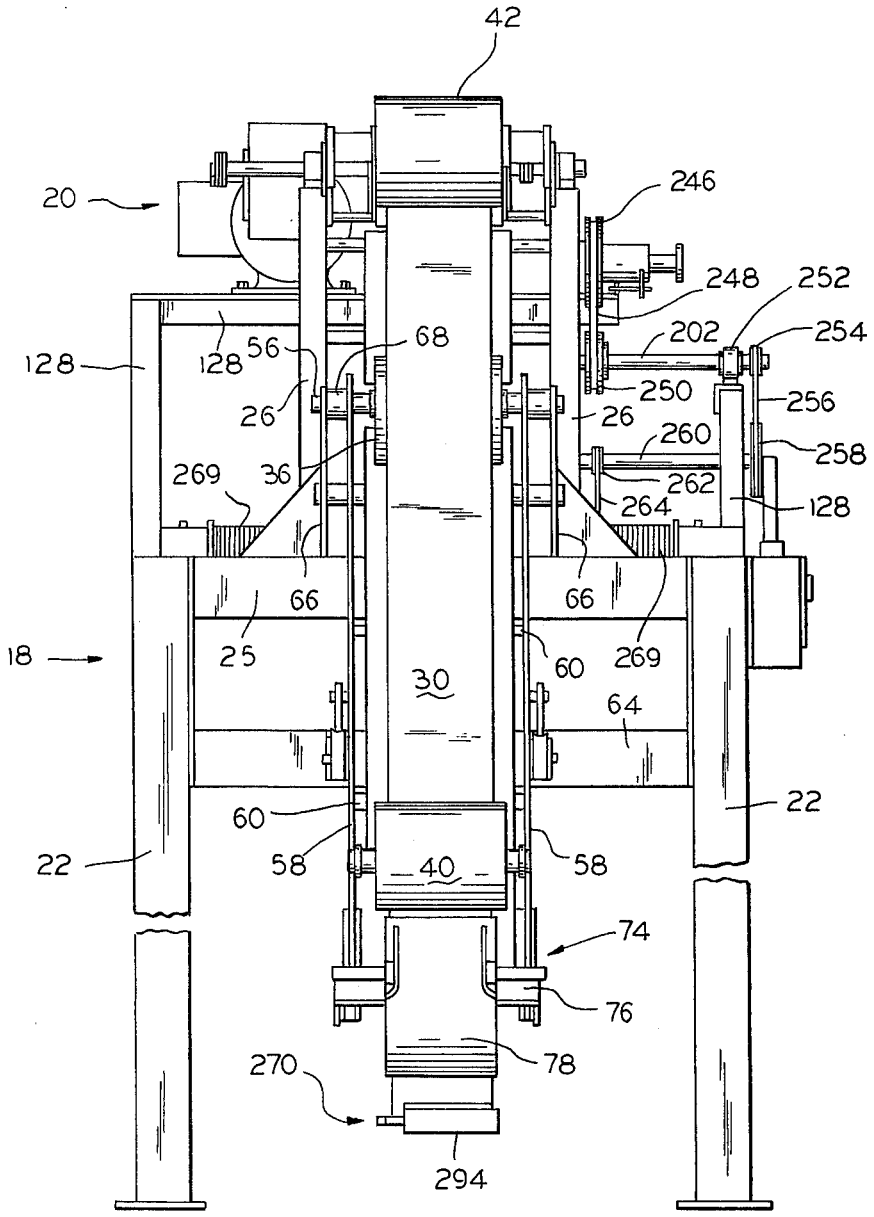
FIG. 2 is a front elevational view of the apparatus shown in FIG. 1.

Referring now to FIGS. 1 and 3, the drive 20 is shown to include a variable speed motor 230 mounted on auxiliary frame portion 143 and coupled through a reduction gear 232 to a sprocket 234 coupled to roller chain 54. This drives the main drive roll 32 through the agency of sprocket 52. A second sprocket 236 (FIG. 3) is also mounted on the shaft 48 of driver roller 32 and is coupled by means of a roller chain 238 to a sprocket 240 mounted on a shaft 242 extending from a gear reduction mechanism 244. Also extending from gear reduction mechanism 244 is an output shaft upon which a pulley 246 is mounted. A belt 248 extends around a first pulley 246 and a second pulley 250 mounted on shaft 202 on one end of which the crank 200 is mounted. Shaft 202 is supported on frame portion 143 by means of suitable bearings 252 and the other end of shaft 202 carries a sprocket 254. A chain 256 (FIG. 2) couples sprocket 254 to a sprocket 258 carried on a shaft 260 suitably journaled for rotation on frame portion 143 and which also carries a second smaller sprocket 262. A chain 264 connects sprocket 262 to a second sprocket 266 mounted on the shaft 192 which carries the cam wheel 194.

It will be appreciated that the drive roller 32 of conveyor 11 is driven by motor 230 through sprockets 234 and 52 and chain 54. The crank 200 which controls movement of the secondary slider 16 is driven by motor 230 through the agency of sprocket 234, chain 54, sprocket 52, sprocket 236, chain 238, sprocket 240, gear reduction mechanism 244, pulley 246, belt 248 and pulley 250. Also, the crank 158 which controls movement of the primary slider assembly 14 is driven through the agency of the same members which drive crank 200 and in addition, sprocket 254, chain 256, sprockets 258 and 262, chain 264 and sprocket 266.

In operation of the strip laying apparatus 10, the strip material 12 is delivered from the process machinery to the lower end of the conveyor 11 where it will be centered by guide assembly 74 and directed beneath the nip roll 40 which will bias the same onto the belt 30. The strip 12 will then be carried by the belt upwardly around tension roller 36 and beneath the guide roller assembly 44 which will direct the same over drive roller 32 and downwardly into the inlet 137 of chute 13. The tapered sides of inlet 137 will prevent jam-up of the strip 12 which will be directed downwardly into the tubular portion 136 of chute 13 for discharge from its lower end.

Simultaneously, the crank 200 will be rotating around the axis of shaft 202 to reciprocate the secondary slider 16 back and forth along the slide tubes 150 so that the chute 13 will be similarly moved backwards and forwards to lay the strip material 12 in rows as seen in FIG. 6. The length of each stroke of the chute 13 and hence the length of each of the rows of the strip material will be governed by the position of the slider member 214 on crank 200. By positioning the slider member closer to the shaft 202, the strokes will be shorter and conversely by positioning the slider closer to the end of crank 200, the strokes will be longer.

Simultaneously with the rotation of crank 200, the cam 194 will also be rotated. However, because of the additional speed reduction introduced by sprockets 254, 258, 262 and 266, the movement of crank 158 which produces lateral movement of the primary slider assembly 14 will be substantially slower than the movement of secondary slider 16. Specifically, the speeds of shafts 202 and 196 will be coordinated such that the secondary slider 16 will reciprocate through a complete cycle while the crank 158 moves the primary slider 14 through a distance equal to one width of the material 12. This will insure that the strip material will be laid in uniform layers and rows.

As indicated above, rotation of cam wheel 194 reciprocates the link 184 longitudinally to pivot crank 158 which in turn moves rod 160 longitudinally to affect movement of the primary slider 14 on slide tubes 146 and 147. The degree of reciprocation of the primary slider 14 can be adjusted by moving the slide bar 168 in slot 166 of crank 158. It will be appreciated that as the slider is moved toward the pivot pin 162, the strokes will become shorter and conversely movement of the slider toward the end of the slot 166 will produce greater movement. Similarly, the degree of lateral movement may also be controlled by placing the link 178 in the selected ones of the holes 176 in crank 156 and the corresponding hole 180 in member 181 affixed to the end of member 184. When the link 178 is disposed in the holes 176 and 180 located toward the outer ends of crank 158 and member 181, less lateral movement of rod 160 will occur while placing the link 178 in the holes more closely located relative to pivot 162 will produce greater degrees of pivotal movement. Bellows 269 of a rubber or rubber coated material may be disposed at each end of the rods 146 and 147.

Figure 10:
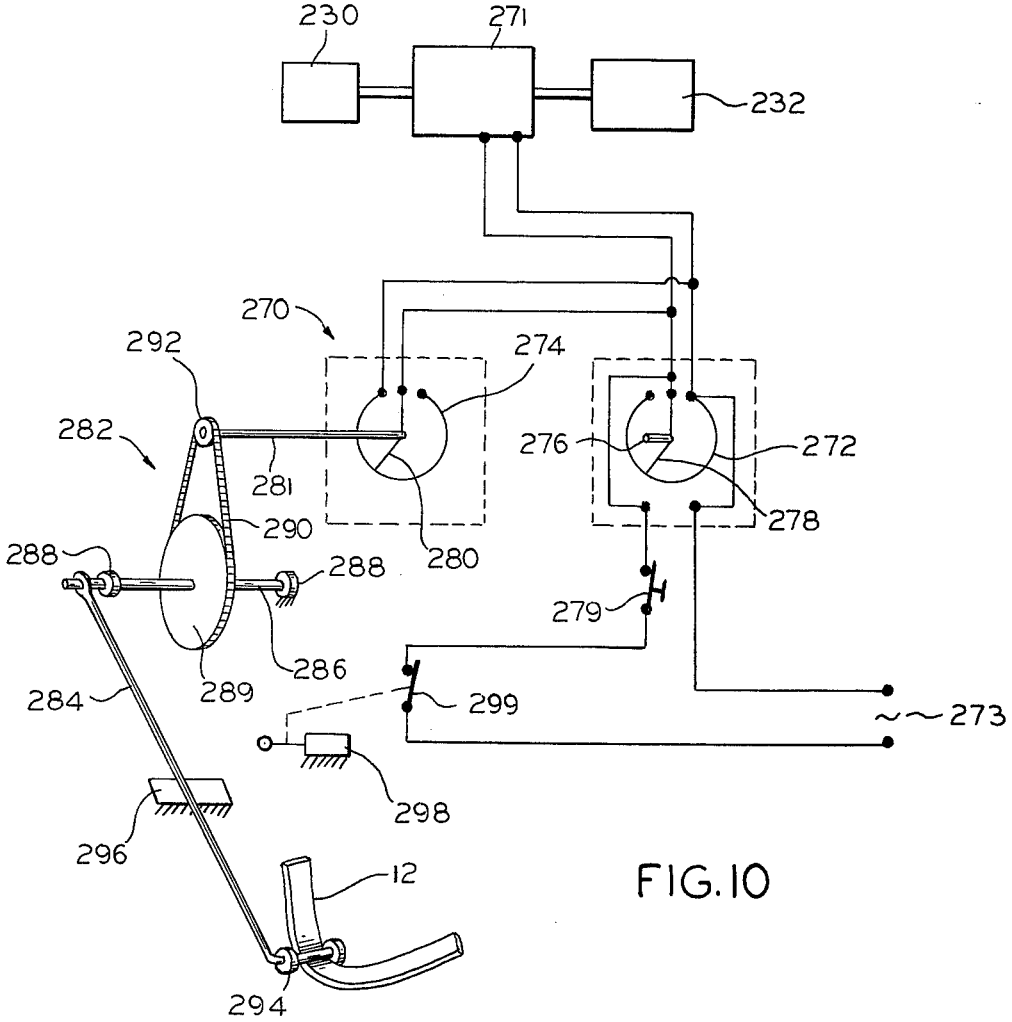
FIG. 10 schematically illustrates a portion of the apparatus shown in FIG. 1.

The strip material 12 is normally delivered to the strip laying apparatus 10 from other process machinery at a nominal rate. It is desirable that the strip laying apparatus operate at the delivery speed to prevent jamming of the equipment. For this reason, the apparatus 10 is capable of speed adjustment. It will be appreciated, however, that although the process machinery may be set to deliver strip material 12 at a nominal speed, in actual practice, the delivery speed may drift from the nominal value. For this reason, a speed matching assembly 270 may be provided as shown in FIG. 10. The assembly 270 adjusts the energization and hence, the degree of slippage of an electromagnetic clutch 271 which connects the motor 230 to the reduction gear 232. Clutch 271 may be of any well-known type wherein for any given input speed, its output speed is directly related to the degree of energization.

More specifically, the energization of clutch 271 is controlled by a first potentiometer 272 connected between an energy source 273 and clutch 271 and a parallel connected second potentiometer 274. Potentiometer 272 has a knob 276 which allows its wiper 278 to be set by an operator. A manually operable on - off switch 279 is also connected in the clutch energizing circuit so that the operator may initiate and terminate operation.

The wiper 280 of the second potentiometer 274 is coupled by a shaft 281 to an adjusting assembly 282 for being adjusted in accordance with the feed rate of the strip material 12. Assembly 282 includes a follower arm 284 affixed to a shaft 286 which is journaled for rotation in bearings 288. Also affixed to shaft 286 is a first sprocket 289 connected by a chain 290 to a second sprocket 292 mounted on shaft 281. A guide roller 294 is rotatably mounted on the free end of arm 284 and is sized to permit the strip material 12 to pass beneath. The roller 294 also gravity biases arm 284 toward a fixedly mounted stop 296.

It will be appreciated that when arm 284 rests against the stop 296, the wiper 280 will have a first setting. However, as the arm 284 pivots upwardly this motion will be transferred by sprockets 289 and 292, chain 290 and shaft 291 so that wiper 280 will move across potentiometer 274. A limit switch 298 is positioned in the pivotal path of arm 284 so as to be engaged when the arm pivots upwardly through a pre-determined angle. Engagement of limit switch 298 by arm 284 will open contacts 299 thereby deenergizing the clutch 271 to stop the operation of the apparatus 10.

The apparatus 270 is normally adjusted so that when arm 284 rests against stop 296, the apparatus 10 is operating at the maximum speed. Also, as arm 284 pivots upwardly, the wiper 280 will be progressively moved across potentiometer 274 so as to progressively increase its resistance and thereby to decrease the speed of the apparatus 10.

It will be appreciated that when the strip material is delivered at the desired rate, the strip material 12 passing beneath arm 284 will hold the arm above the stop 296. If the apparatus 10 is operating at a faster rate than the strip material is delivered, the material will tend to become more taunt thereby causing arm 284 to pivot upwardly. This will cause the apparatus 10 to slow down slightly until the delivery rate and speed of operation of apparatus 10 are again in balance. On the other hand, should the delivery rate of the material 12 be greater than the speed of operation of the apparatus 10, the strip material will become more slack thereby permitting the arm 284 to pivot downwardly. The latter action will cause a repositioning of the wiper 280 so that the machinery 10 will begin operating at a faster rate to bring the delivery and operating rates into balance.

While only a single embodiment of the invention has been illustrated and described, it is not intended to be limited thereby but only by the scope of the appended claims.

I claim:

1. Apparatus for laying strip material including support means, first translating means movably mounted on said support means for reciprocating movement in a first direction and in an opposite direction, said first translating means comprising slider means, first slider supporting means mounted on said support means for supporting said slider means for sliding movement in said first and opposite directions on said support means, said first slider supporting means including elongate means extending in said first direction, said slider means includes tubular means slidably mounted and telescopingly received on said elongate means, second translating means mounted on said first translating means for reciprocating movement in a second direction generally normal to said first direction, said second translating means including second elongated slider support means extending in said second direction and tubular means slidably mounted on said second slider supporting means for reciprocating movement thereon, elongate material distributing means universally pivotally mounted adjacent to an end on said support means and extending generally downwardly therefrom to define upper and lower ends, said material distributing means being constructed and arranged for receiving material at its upper end and discharging the same from its lower end, said distributing means being coupled adjacent its lower end to said second translating means for movement therewith, drive means coupled to each of said translating means for moving said first translating means in said first and said opposite direction and for reciprocating said second translating means in said second direction on said first translating means, an elongate, upwardly inclined conveyor means having one end elevated and disposed adjacent the upper end of said material distributing means, said conveyor means being constructed and arranged for receiving an elongate strip of material, said conveying means including elongate means movable generally upwardly toward the upper end of said distributing means, said conveying means including pressure means for biasing a strip of material against said elongate means whereby the latter moves said material upwardly to said distributing means and guide means disposed above the upper end of said conveying means for redirecting said strip material downwardly to the upper end of said distributing means, said drive means including first crank means mounted for rotation about an axis generally parallel to said first direction and linkage means connecting said crank means to said second translating means for moving the second translating means in said second direction, and means for adjusting the distance from said axis that said crank means is engaged by said linkage means so that adjustment thereof will change the magnitude of reciprocation of said second translating means.

2. The apparatus set forth in claim 1 wherein said elongate means includes upwardly inclined endless belt means having upper and lower portions and an outer surface, said pressure means comprises pressure roller means adjacent the lower portion of said endless belt means and opposed to said outer surface whereby strip material is biased by said pressure roller means against the outer surface of said belt means, drive means coupled to said belt means for moving the same whereby strip material biased against said belt means will be carried to said upper end of said distributing means, and said guide means comprising guide roller means mounted adjacent the upper portion of said elongate means for redirecting said strip material downwardly to the upper end of said distributing means.

3. The apparatus set forth in claim 2 wherein said guide roller means comprises a plurality of rollers disposed above said belt means and extending in a direction generally normal to the direction of movement of said belt means, and frame means disposed adjacent the opposite sides of said belt means for supporting said guide roller means, said frame means being articulated and conforming generally to said belt means at a point above said second roller means.

4. The apparatus set forth in claim 2 wherein said conveying means includes a plurality of roller means, said endless belt means extending over said roller means, at least one of said roller means being coupled to said drive means for moving said belt means over said roller means, a first one of said roller means being disposed at a lower elevation than a second one of said roller means whereby said endless belt means extends generally in an upward direction, said pressure roller means being disposed adjacent said first roller means.

5. The apparatus set forth in claim 4 and including second guide means disposed adjacent said first roller means and constructed and arranged for guiding said strip material between said pressure roller means and said belt means.

6. The apparatus set forth in claim 5 wherein said second guide means include second guide roller means mounted adjacent the second one of said roller means and including a first portion adjacent the outer surface of said belt means and spaced therefrom so that said strip material will move between said belt means and said second guide roller means, said second guide roller means including a second portion generally tangent to said belt means and extending toward the upper end of said distributing means for redirecting said strip material from said belt means to said distributing means.

7. The apparatus set forth in claim 6 and including second pressure roller means adjacent said second guide roller means and biased toward contact with the outer surface of said belt means for biasing said strip material against said belt means prior to the passage of said material beneath said second guide roller means.

8. The apparatus set forth in claim 7 wherein said second guide roller means comprises a plurality of rollers disposed above said belt means and extending in a direction generally normal to the direction of movement of said belt means, and frame means disposed adjacent the opposite sides of said belt means for supporting said guide roller means, said frame means being articulated and conforming generally to said belt means at a point above said second roller means.

9. The apparatus set forth in claim 8 wherein said material distributing means is hollow and is pivotally mounted adjacent its upper end and including an outwardly belled hollow portion adjacent said upper end for receiving said material.

10. The apparatus set forth in claim 1 and including second crank means mounted for pivotal movement in said first direction, second linkage means connecting said second crank means to said first translating means, and means for pivoting said second crank means for moving said first translating means in said first direction.

11. The apparatus set forth in claim 10 and including means coupling said second crank means to said drive means, said coupling means including cam follower means coupled to said second crank means, and cyclic cam means for engaging said cam follower means and moving the same in a cyclic manner for pivoting said second crank means.

12. The apparatus set forth in claim 3 and including second crank means mounted for pivotal movement in said first direction, second linkage means connecting said second crank means to said first translating means, and means for pivoting said second crank means for moving said first translating means in said first direction.

13. The apparatus set forth in claim 12 and including means coupling said second crank means to said drive means, said coupling means including cam follower means coupled to said crank means, and cyclic cam means for engaging said cam follower means and moving the same in a cyclic manner for pivoting said second crank means.

14. The apparatus set forth in claim 1 wherein said drive means includes speed adjustable output means coupled to said conveyor means for driving said conveyor means to discharge said material at a rate functionally related to the speed to which said output means is adjusted, and speed matching means including sensing means for sensing the rate at which material may be delivered from another apparatus, control means coupled to said sensing means and to said output means for controlling the speed of said output means in relation to the delivery rate of said material.

15. Apparatus for laying a strip material including support means, first translating means movably mounted on said support means for reciprocating movement in a first direction and in an opposite direction, second translating means mounted on said first translating means for reciprocating movement in a second direction generally normal to said first direction, elongate material distributing means universally pivotally mounted on said support means and extending generally downwardly to define upper and lower ends for receiving material at its upper end and discharging the same from its lower end, said distributing means being coupled adjacent its lower end to said second translating means for movement therewith, drive means coupled to each of said translating means for moving said first translating means in said first and said opposite direction and for reciprocating said second translating means in said second direction on said first translating means, and conveyor means for receiving an elongate strip of material and conducting said material upwardly and for delivering the same to the upper end of said distributing means, said first translating means comprising slider means, first slider supporting means mounted on said support means for supporting said slider means for sliding movement in said first and opposite directions on said support means, said first translating means also including second slider supporting means extending in said second direction, said second translating means including tubular means slidably mounted on said second slider supporting means for reciprocating movement thereon.

said first slider supporting means includes elongate means extending in said first direction, said slider means includes tubular means slidably mounted and telescopingly received on said elongate means, said drive means including first crank means mounted for rotation about an axis generally parallel to said first direction and linkage means connecting said crank means to said second translating means for moving the second translating means in said second direction, and means for adjusting the distance from said axis that said crank means is engaged by said linkage means so that adjustment thereof will change the magnitude of reciprocation of said second translating means.

16. The apparatus set forth in claim 15 and including second crank means mounted for pivotal movement in said first direction, second linkage means connecting said second crank means to said first translating means, and means for pivoting said second crank means for moving said first translating means in said first direction.

17. The apparatus set forth in claim 16 and including means coupling said second crank means to said drive means, said coupling means including cam follower means coupled to said crank means, and cyclic cam means for engaging said cam follower means and moving the same in a cyclic manner for pivoting said second crank means.

18. Apparatus for laying a strip material including support means, first translating means movably mounted on said support means for reciprocating movement in a first direction and in an opposite direction, second translating means mounted on said first translating means for reciprocating movement in a second direction generally normal to said first direction, elongate material distributing means mounted on said support means for generally universal pivotal movement and for receiving material at one end and discharging the same from its other end, said distributing means being coupled to said second translating means for movement therewith, drive means coupled to each of said translating means for moving said first translating means in said first and said opposite direction and for reciprocating said second translating means in said second direction on said first translating means, and conveyer means for receiving an elongate strip of material and conducting said material upwardly to the one end of said distributing means, said drive means includes crank means pivotally mounted about a pivot axis for movement in a plane generally parallel to one of said directions and linkage means connected to one of said first and second translating means and to said crank means at a distance from said pivot axis for moving the one of said first and second translating means in the one of said directions and means for adjusting the distance from said pivot axis that said crank means is engaged by said linkage means so that adjustment thereof will change the magnitude of reciprocation of said one of said first and second translating means.

19. The apparatus set forth in claim 18 and wherein said crank means is coupled to said second translating means, and including second crank means pivotally mounted for movement in said first direction, second linkage means connecting said second crank to said first translating means, and means for pivoting said second crank means for moving said first translating means in said first direction.

20. The apparatus set forth in claim 18 and including coupling means connecting said second crank means to said drive means, said coupling means including cam follower means coupled to said second crank means, and cyclic cam means for engaging said cam follower means and moving the same in a cyclic manner for pivoting said second crank means.

21. Apparatus for laying a strip material including support means, first translating means movably mounted on said support means for reciprocating movement in a first direction and in an opposite direction, second translating means mounted on said first translating means for reciprocating movement in a second direction generally normal to said first direction, distributing means coupled to said second translating means for movement therewith, conveyer means for receiving an elongate strip of material from other apparatus and for conducting said material to said distributing means and for delivering the same thereto at a given rate, and drive means coupled to said conveyer means and having an adjustable output for driving said conveyer means to discharge said material at a rate functionally related to the speed at which said output means is adjusted, and speed matching means for matching the speed of said output means in relation to the delivery speed of material from said other apparatus and including sensing means for providing a signal in response to the rate at which material is delivered from said other apparatus and control means coupled to said sensing means for receiving said signal and to said output means for controlling the speed of said output means in relation to the delivery rate of said material.

22. The apparatus set forth in claim 21 wherein said sensing means comprises translatable means movable between first and second positions, movement of said translatable means toward said first position being operative to increase the speed of said output means and movement of said translatable means toward said second position being operative to decrease the speed of said output means, said translatable means engaging said material, said material being operative to affect movement of said translatable means toward said first position when the output speed is less than that required to maintain a desired speed relation and for moving said translatable means toward said second position when said output speed exceeds that required to maintain said speed relation.

23. The apparatus set forth in claim 22 wherein said sensing means comprises pivotally mounted arm means engaging said material, said material being effective to pivot said arm means in a first direction when the conveyer discharge rate is less then a desired discharge rate and for pivoting said arm means in an opposite direction when said delivery rate exceeds the desired discharge rate.

24. The apparatus set forth in claim 23 wherein said drive means includes electroresponsive means operative to vary the speed of the output means in response to an electrical signal, said control means being operative to modify an electrical signal in relation to the position of said arm means, said drive means being responsive to variations in said electrical signal.

25. The apparatus set forth in claim 24 and including a second electric control means coupled to said drive means, and manually operable means for adjusting said second control means to preset an initial output speed of said drive means, said first control means being operative to modify said preset output speed.

26. The apparatus set forth in claim 25 wherein said arm means includes material engaging means, said material passing beneath said material engaging means for pivoting said arm means upwardly when said material becomes taunt as a result of the discharge rate exceeding rate at which said material is delivered and for permitting said arm means to pivot downwardly when said material becomes slack as a result of the delivery speed exceeding the discharge rate.

27. The apparatus set forth in claim 26 and including limit means adjacent the first position, said arm means engaging said limit means to disable said drive means after said arm means is pivoted through a predetermined angle.

28. The apparatus set forth in claim 27 wherein said drive means includes motor means and electroresponsive clutch means, said first and second control means comprising first and second potentiometers coupled in the energizing circuit of said clutch means and including a wiper, said arm means being coupled to the wiper of one of said potentiometer means.

29. The apparatus set forth in claim 28 and including first and second shaft means, said arm means being mounted on said first shaft means and the wiper of said first potentiometer mounted on said second shaft means, and means for coupling said first and second shaft means so that said potentiometer wiper moves in a predetermined relation to the pivotal movement of said arm means.

30. The apparatus set forth in claim 29 wherein said conveyor means includes endless belt means extending generally upwardly, pressure roller means adjacent the lower portion of said endless belt means whereby strip material is biased by said pressure roller means against said belt means, drive means for said belt means for moving the same whereby strip material biased against said belt means will be carried to said upper end of said material distributing means, and guide roller means mounted adjacent said belt means for redirecting said strip material downwardly into the upper end of said material distributing means.

31. The apparatus set forth in claim 30 wherein said conveying means includes a plurality of roller means, said endless belt means extending over said roller means, at least one of said roller means being coupled to said drive means for moving said belt means over said roller means, a first one of said roller means being disposed at a lower elevation than a second one of said roller means whereby said endless belt means extends generally in an upward direction, said pressure roller means being disposed adjacent said first roller means.

32. The apparatus set forth in claim 22 and including limit means adjacent the first position, said translatable means engaging said limit means to disable said drive means after said translatable means has moved a predetermined distance toward said first position.

33. The apparatus set forth in claim 22 wherein said sensing means comprises pivotally mounted arm means engaging said material, said material being effective to pivot said arm means in a first direction when the conveyer discharge rate is less than a desired discharge rate and for pivoting said arm means in an opposite direction when said delivery rate exceeds the desired discharge rate.

34. The apparatus set forth in claim 33 wherein said arm means includes material engaging means, said material passing beneath said material engaging means for pivoting said arm means upwardly when said material becomes taunt as a result of the discharge rate exceeding the take-up rate, and for permitting said arm means to pivot downwardly when said material becomes slack as a result of the take-up speed exceeding the discharge rate.

35. The apparatus set forth in claim 22 wherein said drive means includes motor means and said output means comprises electroresponsive clutch means having an energizing circuit, said control means comprising first and second potentiometers coupled in the energizing circuit of said clutch means and including a wiper, said sensing means being coupled to the wiper of one of said potentiometer means.

36. The apparatus set forth in claim 22 wherein said sensing means is operative to adjust said control means in functional relation to the difference in the delivery and feed rates, said drive means including electroresponsive means operative to vary the speed of the output means in response to an electrical signal, said control means being operative to provide an electrical signal in relation to the adjustment thereof by said sensing means, said drive means being responsive to variations in said signal.

37. The apparatus set forth in claim 36 and including a second control coupled to said drive means, and manually operable means for adjusting said second control means to preset an initial output speed of said drive means, said first control means being operative to modify said preset output speed.

* * * * *